US005189348A

United States Patent [19]

Yokota et al.

[11] Patent Number: 5,189,348

[45] Date of Patent: Feb. 23, 1993

[54] CATHODE RAY TUBE APPARATUS INTENDED TO REDUCE MAGNETIC FLUXES LEAKED OUTSIDE THE APPARATUS

[75] Inventors: Masahiro Yokota; Hideo Mori, both of Fukaya; Kiyoshi Oyama, Yokohama, all of Japan

[73] Assignee: Kabushiki Kaisha Toshiba, Kawasaki, Japan

[21] Appl. No.: 888,281

[22] Filed: May 26, 1992

Related U.S. Application Data

[63] Continuation of Ser. No. 535,197, Jun. 8, 1990, abandoned.

[30] Foreign Application Priority Data

Jun. 9, 1989 [JP] Japan ..... 1-146979

[51] Int. Cl.[5] ..... G09G 1/04; H01J 29/06

[52] U.S. Cl. ..... 315/399; 315/8; 335/210

[58] Field of Search ..... 315/399, 370, 8; 335/210, 213

[56] References Cited

U.S. PATENT DOCUMENTS

| | | | |
|---|---|---|---|
| 4,709,220 | 11/1987 | Sakane et al. | 335/214 |
| 4,851,737 | 7/1989 | Johansson et al. | 335/213 |
| 4,857,805 | 8/1989 | Bosch et al. | 315/370 |
| 4,922,167 | 5/1990 | Sluyterman et al. | 335/213 |

FOREIGN PATENT DOCUMENTS 62-100935 5/1987 Japan .

WO87/05437 9/1987 PCT Int'l Appl. .

OTHER PUBLICATIONS

IBM Technical Disclosure, vol. 30, No. 12, May 1988 "Cancellation of Leaked Magnetic Flux".

Patent Abstracts of Japan, Unexamined Applications, Sep. 12, 1987 E. Field, vol. 11, No. 284, p. 95 E 540 Kokai-No. 62-82 632 (Mitsubishi Electric).

Patent Abstracts of Japan, Unexamined Applications, Jun. 25, 1988, E. Field, vol. 12, No. 225, p. 165 E 626 Kokai-No. 63-19 740 (Denki Onkyo).

IBM Technical Disclosure Bulletin, vol. 30, No. 12, May 1988, New York U.S. "Cancellation of Leaked Magnetic Flux", pp. 9-10.

MPR, Series MPS 1988, Guide to the Evaluation of Reports on the Testing of Visual Display Terminals.

*Primary Examiner*—Gregory C. Issing

*Attorney, Agent, or Firm*—Cushman, Darby & Cushman

[57] ABSTRACT

In a cathode ray tube apparatus, a deflection yoke for generating an effective magnetic field to deflect electron beams in an envelope is provided around a funnel of the envelope. A pair of front magnetic coils are in substantially symmetrical with respect to a horizontal plane including a tube axis and a horizontal direction and are provided on a skirt of the envelope. A pair of rear magnetic coils are also arranged in substantially symmetrical with respect to the horizontal plane and are provided on the deflection yoke. Leakage magnetic fluxes generated from the deflection yoke are reduced by compensating magnetic fluxes generated from the front and rear magnetic coils.

13 Claims, 7 Drawing Sheets

CATHODE RAY TUBE APPARATUS INTENDED TO REDUCE MAGNETIC FLUXES LEAKED OUTSIDE THE APPARATUS

This is a continuation of application Ser. No. 07/535,197, filed on Jun. 8, 1990, which was abandoned upon the filing hereof.

BACKGROUND OF THE INVENTION

1. Field of the Invention

The present invention relates to a cathode ray tube apparatus and, more particularly, a cathode ray tube apparatus intended to reduce magnetic fluxes leaked outside the apparatus from a horizontal deflection coil unit of the deflection yoke.

2. Description of the Related Art

As the VDUs (visual display units) become more and more popular in the community of users, dispute has been focused on how the human body is effected by magnetic fields leaked from the VDU. It is not yet concluded whether or not the magnetic fluxes leaked have any effect on the human body and what what the effects are. However, the Northern Europe has issued a notice to attract attention to the effect that the leakage magnetic fluxes have on the human body. The National Council for Metrology and Testing in Sweden, for example, recommends in a guide line (MPR-P 1988) relating to the rules of testing and evaluating the VDUs that the magnetic fields, particularly horizontal deflection magnetic fluxes leaked on a sphere which has a radius of 65 cm (or 50 cm in front of the face plate on the tube axis) around the center of the VDU (or a point separated 15 cm inward from the surface of the face plate along the tube axis) should have a magnetic flux density B equal to or smaller than 50 nT and an induced magnetic flux density dB/dt equal to or smaller than 25 mT/s.

The magnetic fluxes are mainly leaked from a horizontal deflection coil of the deflection yoke attached to the cathode ray tube. The deflection yoke is usually provided with a magnetic core and horizontal and vertical deflection coil units, and magnetic fields shown by broken lines in FIG. 1 are generated by the horizontal deflection coil unit 1 which is wound like a saddle around the tube. These horizontal deflection magnetic fluxes are generally grouped into effective magnetic fluxes Ba and ineffective magnetic fluxes Bb generated by flange portions 2 of the horizontal deflection coil unit 1. These deflection magnetic fluxes Ba and Bb are generated in those directions which are opposite to each other. These deflection magnetic fluxes Ba and Bb are particularly complicated adjacent to the deflection yoke 3 but simple, as shown by arrows 4 in FIG. 2A, on a plane separated about 45 cm from the center of the VDU and perpendicular to the tube axis. The simple leakage magnetic fluxes are distributed, as shown by arrows 5 in FIG. 2B, like a distribution of the magnetic fluxes generated from a coil unit 6 which is located to generate magnetic fluxes Bc directed in a direction opposite to that of the effective magnetic fluxes Ba in the center of the VDU.

As shown in FIGS. 3A and 3B, in a cathode ray tube apparatus 9, a pair of compensating coil units for eliminating the leaking horizontal deflection magnetic fluxed, 8*a* and 8*b*, are arranged on both sides of the horizontal plane aligned with the tube axis Z and on a plane perpendicular to the horizontal plane and passing through the center O of the leakage magnetic fluxes. Horizontal deflection current is applied to the pair of compensating coil units 8*a* and 8*b* to generate magnetic fluxes to cancel the magnetic fluxes Bb passing through the coil units 8*a* and 8*b*. In other words, magnetic fluxes which are directed in the same direction as that of the effective magnetic fluxes Ba are generated to reduce the leakage magnetic fluxes.

In the case of the conventional cathode ray tube apparatus 9, however, a phase difference $\Delta\phi$ or time lag is caused, as shown in FIGS. 4A and 4B, between a waveform 10 of the magnetic fluxes generated by the paired compensating coil units and a waveform 11 of the leakage magnetic fluxes, due to the inner magnetic shield, shadow mask and dag-coating which are incorporated in the monochromatic or color cathode ray tube and which are located adjacent to the paired compensating coil units 8*a* and 8*b*. This makes it difficult to fully compensate the leaking magnetic fluxes. Further, the impedance of the deflecting circuit is increased and the deflecting power loss is increased accordingly, because horizontal deflection current is applied to the paired compensating coil units. Still further, the paired compensating coil units attached to the tube are left unstable and attaching them to the tube is difficult because they must be attached to the tilted outer face of the center portion of the cone of the tube.

SUMMARY OF THE INVENTION

The object of the present invention is therefore to provide a cathode ray tube apparatus capable of more fully compensating the leakage magnetic fluxes on the sphere which has a radius of 65 cm around the center of the VDU, more easily reducing particularly the leakage magnetic flux in front of the screen, and reducing the deflecting power loss to a greater extent due to compensating coil units.

According to the present invention, there is provided a cathode ray tube apparatus comprising a means for generating electron beam; means for emitting light rays when the electron beam is landed thereon; an envelope, having an axis, for receiving the electron beam generating means and light ray generating means; means, provided on the envelope, for generating effective magnetic fluxes in the envelope to deflect the electron beam in the horizontal direction and also generating leakage magnetic fluxes outside the envelope; a first means, provided at a first side of the light rays generating means in respect to a first reference plane perpendicular to the axis and crossing the envelope, for generating first compensating magnetic fluxes in a direction opposite to that of the leakage magnetic fluxes; a second means, provided at a side of the electron beams generating means in respect to the first reference plane, for generating second compensating magnetic fluxes in the direction opposite to that of the leakage magnetic fluxes; and a signal generator means for generating a signal to energize the deflection magnetic flux generating means and the first and second compensating magnetic flux generating means.

According to the present invention, there also is provided a cathode ray tube apparatus comprising an envelope, having an axis, including a face plate, a panel provided with a skirt continuous to the face plate, a funnel connected to the skirt of the panel and a neck extending from the funnel; an electron gun assembly, received in the neck, for generating an electron beam; a screen, formed on the face plate, for generating light rays when the electron beam is landed thereon; means, provided at the funnel, for generating magnetic fluxes to deflect the electron beam in the horizontal direction and leakage magnetic fluxes outside the envelope; first and second electromagnetic coil units, located at both sides of a horizontal reference plane parallel to the horizontal direction and aligned with the tube axis, respectively, and at the face plate side of a vertical reference plane perpendicular to the horizontal reference plane, for generating first compensating magnetic fluxes in a direction reverse to that of the leakage magnetic fluxes outside the envelope; and third and fourth electromagnetic coil units, located at both sides of the horizontal reference plane, respectively, and at the neck side of the vertical reference plane, for generating second compensating magnetic fluxes in the direction opposite to that of the leakage magnetic fluxes outside the envelope.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

Figure 5A:
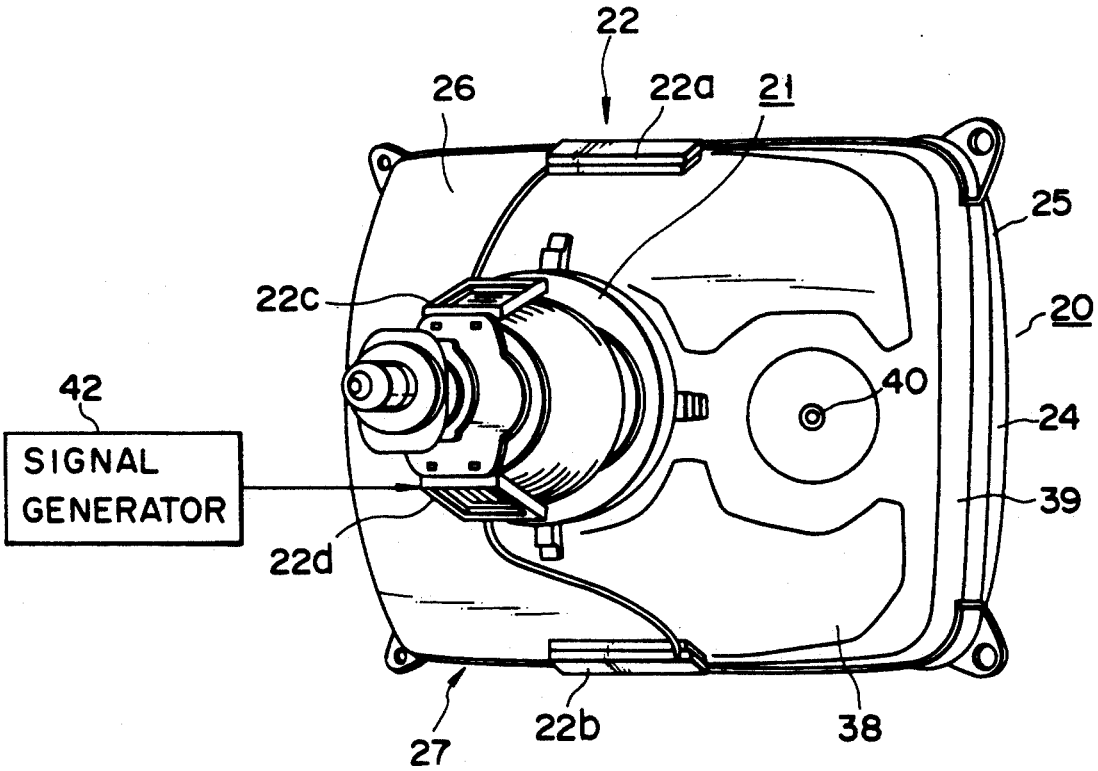
FIGS. 5A and 5B are perspective rear and partly-broken side views showing an example of the color cathode ray tube apparatus according to the present invention.
Figure 5B:
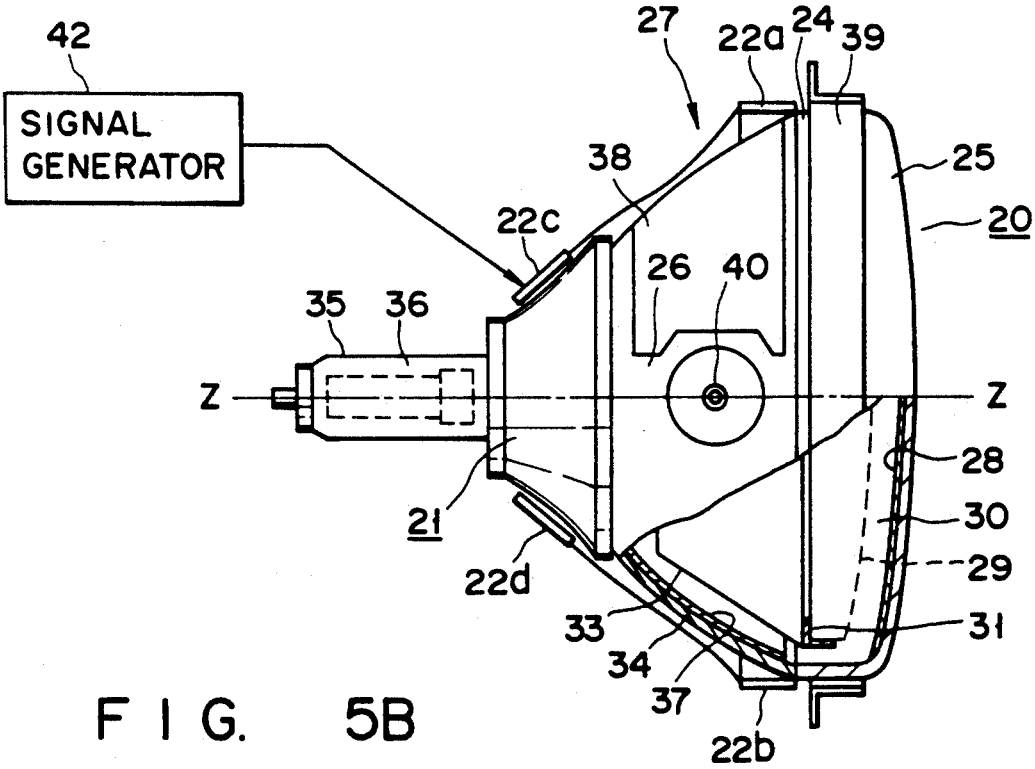

FIGS. 5A and 5B show a color cathode ray tube apparatus according to one embodiment of the present invention. The cathode ray tube apparatus includes a color cathode ray tube 20, a deflection yoke 21 attached to the outer circumference of the tube 20, and a compensating assembly 22 similarly attached to the outer circumference of the tube 20 to generate compensating magnetic fluxes. The color cathode ray tube 20 has an envelope 27 comprising a panel 25 provided with a face plate and a skirt 24 along the outer rim thereof and a funnel 26 integrally connected to the panel 25. Formed on the inner face of the face plate is a phosphor screen 28 comprising three phosphor layers for emitting blue, green and red light rays when electron beams land on these layers. A shadow mask 29 is arranged adjacent to the phosphor screen 28 and inside the panel 25. The shadow mask 29 is provided with apertures through which the electron beams are allowed to pass, and it includes a mask body 30 opposed to the phosphor screen 28 and a mask frame 31 for supporting the outer rim portion of the mask body 30. These components are made of magnetic material such as low carbon steel. An inner magnetic shield 33 also made of magnetic material is attached to the mask frame 31 of the shadow mask 29 and projected from the mask frame 31 into a conical portion 34 of the funnel 26. An electron gun assembly 36 for generating three electron beams is arranged in a neck 35 of the funnel 26. An inner dag-coating 37 is formed on the inner face of the cone 34 of the funnel 26, spreading near to the inner face of the neck, and an outer dag-coating 38 is formed on the outer face of the cone 34.

Reference numeral 39 represents an explosion-proof band for tightening the skirt 24 of the panel 25 and reference numeral 40 denotes a positive electrode terminal located at the cone 34 of the funnel 26.

The deflection yoke 21 is attached to the outer surface of the cone 34 and the neck 35. The deflection yoke 21 comprises a horizontal deflection coil unit for deflecting those three electron beams, which are emitted from the electron gun assembly 36, in the horizontal direction, a vertical deflection coil unit for deflecting the electron beams in the vertical direction, and a magnetic core. Particularly the deflection yoke 21 of the cathode ray tube apparatus shown in FIGS. 5A and 5B includes at least the horizontal deflection coil unit wound like a saddle, and the magnetic core.

In the case of the cathode ray tube apparatus shown in FIGS. 5A and 5B, the compensating assembly 22 for generating compensating magnetic fields comprises a front side pair of compensating coil units **22*a*, 22*b* and a rear side pair of compensating coil units 22*c*, 22*d* which are located on both sides of a plane 7 perpendicular to the tube axis and passing through the center of horizontal deflection leakage magnetic fluxes generated from the horizontal deflection coil unit of the deflection yoke 21. The front side pair of compensating coil units 22a and 22b are symmetrical relative to a horizontal plane which is aligned with the axis Z of the color cathode ray tube 20, and the compensating coil units 22a and 22b are fixed by adhesive, for example, to the outer face of the skirt 24 of the panel 25 in which the shadow mask 29 is arranged or to that of the cone 34 of the funnel 26 in which the inner magnetic shield 33 is arranged, in such a way that the compensating coil units 22a and 22b are opposed to each other with the horizontal plane interposed between them. Particularly in the case of fixing the compensating coil units 22a and 22b onto the skirt 24 of the panel 25, they can be easily affixed, using the explosion-proof band 39 which tightens the skirt 24. Similarly, the rear side pair of compensating coil units 22c and 22d are symmetrical relative to the horizontal plane which is on the axis Z of the color cathode ray tube and the compensating coil units 22c and 22d are fixed to the magnetic core of the deflection yoke 21 in such a way that they are opposed to each other with the horizontal plane interposed between them. Coil units 22a and 22b are substantially the same in size and shape and coil units 22c and 22d are also substantially the same in size and shape but it is determined by the distribution of magnetic fields leaked outside the envelope how many turns their coils have and how they are tilted relative to the horizontal plane. They are connected in series or parallel to the horizontal deflection coil unit of the deflection yoke 21 and energized by a signal applied from a signal generator 42. The signal generator 42 includes a horizontal signal generator circuit for generating horizontal deflection current, and current which is proportional to the horizontal deflection current is supplied from this signal generator 42 to the compensating coil units 22a, 22b, 22c and 22d. It may be designed that the signal generator 42 is kept independent of the horizontal signal generator circuit. Current proportional in a level to, synchronous with and same in time change as the horizontal deflection current is supplied from the signal generator 42 to the compensating coil units 22a, 22b, 22c and 22d** in this case.

When the front and rear sides pairs of compensating coil units 22a, 22b and 22c, 22d are attached to the the color cathode ray tube as described above, leakage magnetic fluxes can be efficiently compensated as follows.

Figure 6:
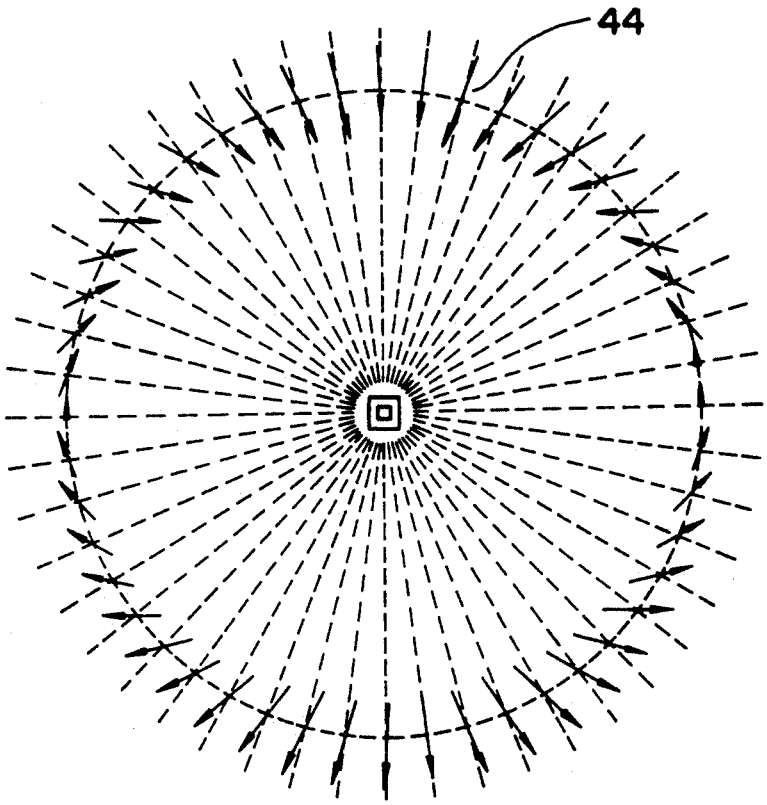
FIG. 6 shows a distribution of compensating magnetic fluxes on a vertical plane separated by 65 cm from the center of VDU in the color cathode ray tube apparatus shown in FIGS. 5A and 5B.

1) When positions of the front and rear sides pairs of compensating coil units 22a, 22b, 22c and 22d and current applied to these coil units are adjusted, leakage magnetic fluxes can be effectively compensated. FIG. 6 shows compensating magnetic fluxes on a vertical plane located 15 cm inside the outer face of the panel 26 of the color cathode ray tube 20 and separated 65 cm from the center of the VDU according to the examination and evaluation rule for the VDU, and as shown by arrows 44 in FIG. 6, compensating magnetic fluxes are formed similar to those of the conventional cathode ray tube apparatus in which a pair of compensating coil units are arranged on the plane passing through centers of horizontal deflection leakage magnetic fluxes.

Figure 1:
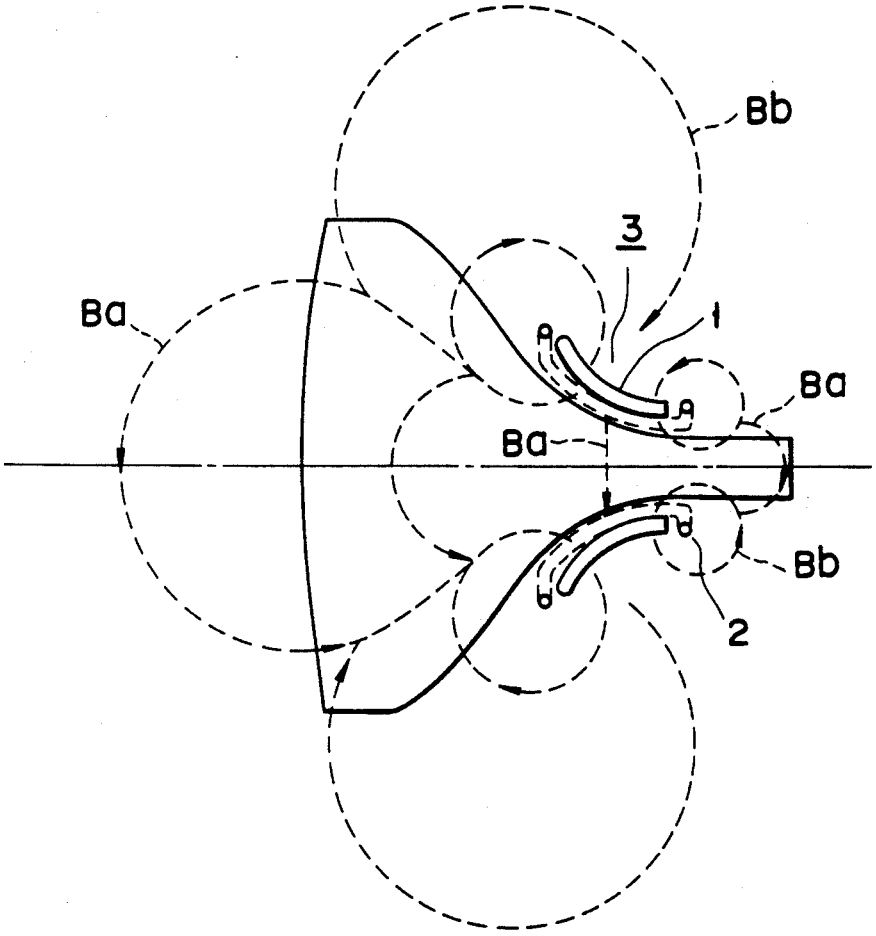
FIG. 1 (prior art) shows a distribution of horizontal deflection leakage magnetic fluxes around the cathode ray tube generated from horizontal deflection coil units of the saddle type for the deflection yoke.
Figure 2A:
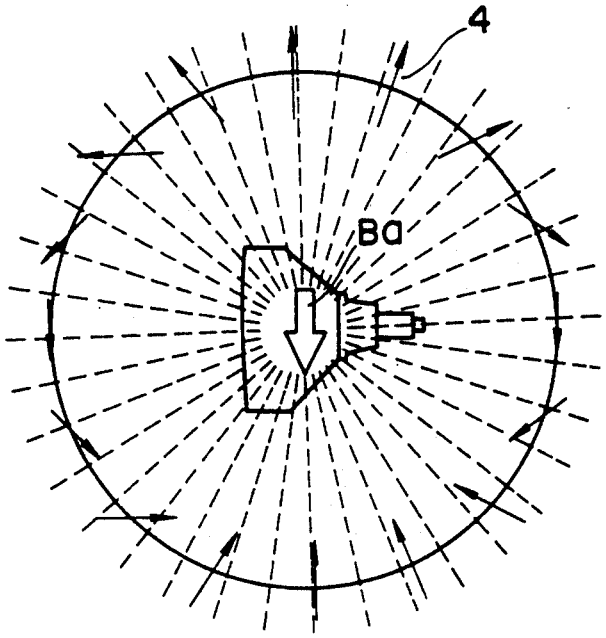
FIG. 2A (prior art) shows a distribution of horizontal deflection leakage magnetic fluxes on a vertical plane separated by 65 cm from the center of VDU.
Figure 2B:
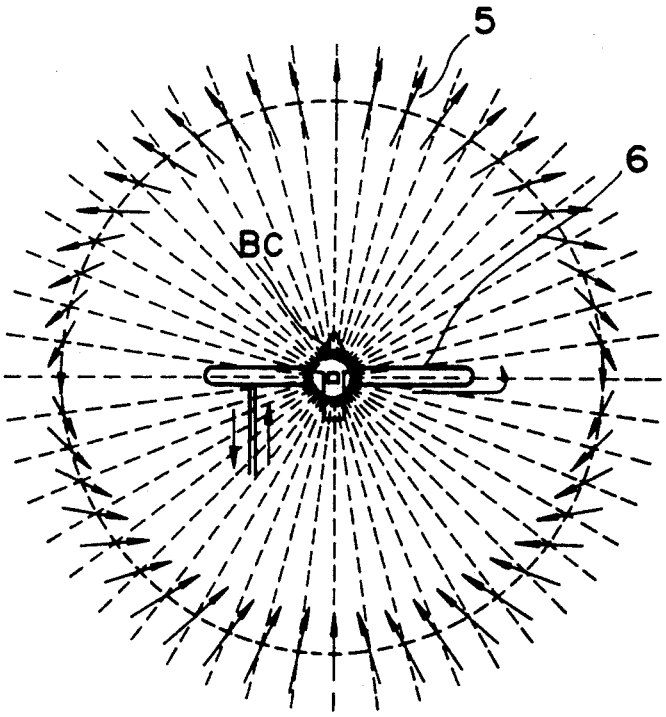
FIG. 2B shows a distribution of magnetic fluxes generated when a coil unit is so located around VDU as to generate magnetic fluxes reversely directed from those effective magnetic fluxes which are generated from the horizontal deflection coil unit.
Figure 3A:
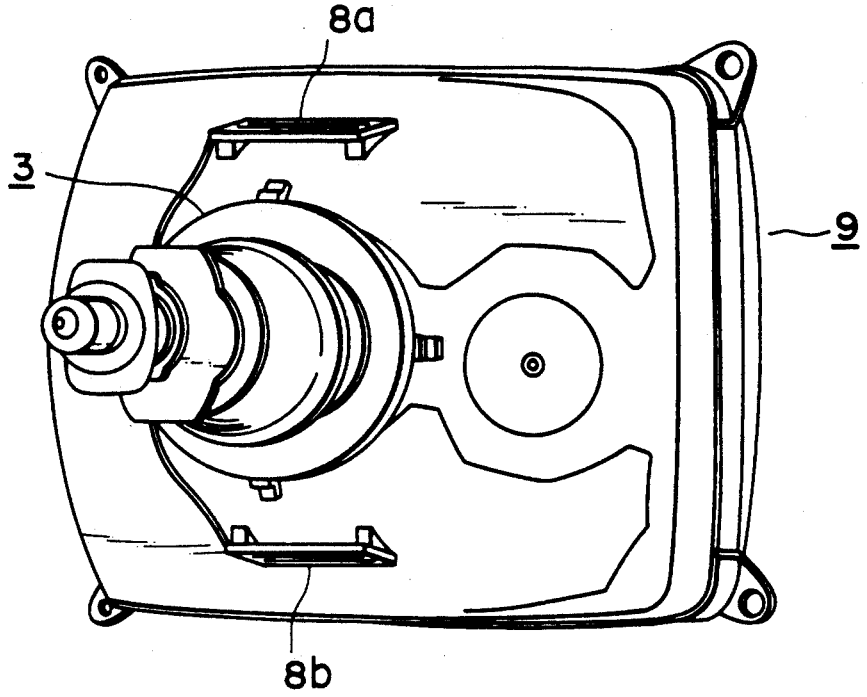
FIGS. 3A and 3B (prior art) are perspective rear and side views showing the conventional cathode ray tube apparatus in which a pair of compensating coil units are arranged on both sides of a horizontal plane including the tube axis and on a plane perpendicular to the tube axis and passing through center of leakage magnetic fluxes.
Figure 3B:
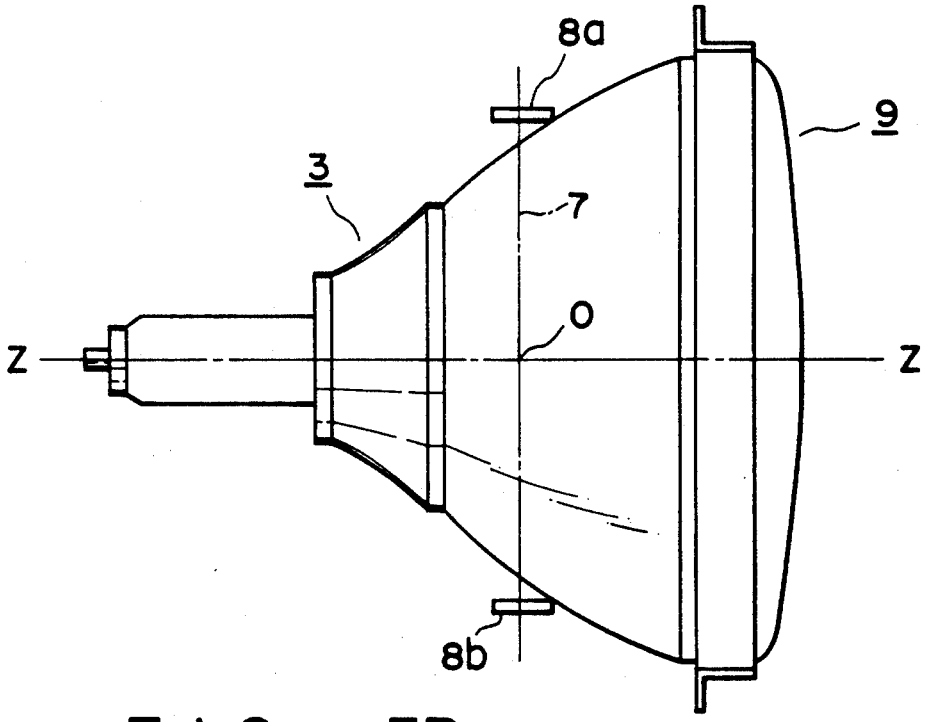
Figures 4A, 4B:
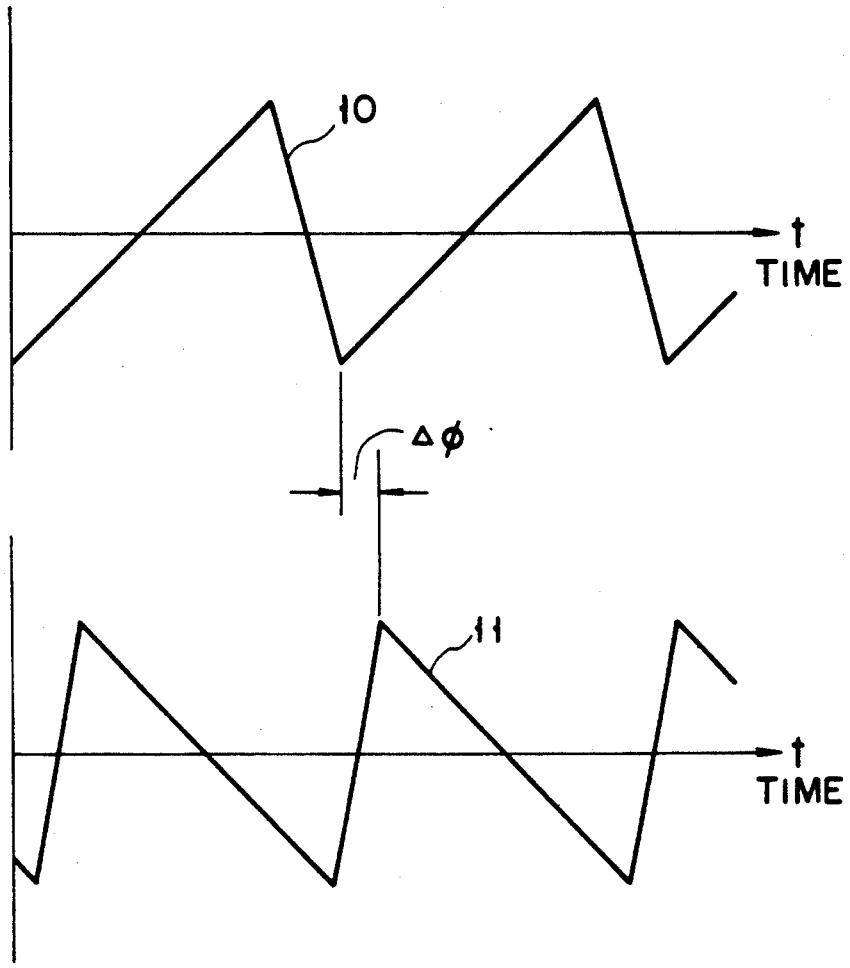
FIG. 4A (prior art) shows a waveform of compensating magnetic field generated from the compensating coil unit synchronous with horizontal deflection signal.
FIG. 4B (prior art) shows a waveform of leakage magnetic fluxes from VDU.

2) Leakage magnetic fluxes could not be compensated to the full extent by the conventional cathode ray tube apparatus because horizontal deflection leakage magnetic fluxes are different in phase from compensating magnetic fluxes as shown in FIGS. 4A and 4B. When the front and rear sides pairs of compensating coil units are arranged as shown in FIGS. 5A and 5B, however, compensating magnetic fluxes which are substantially in phase with horizontal deflection leakage magnetic fluxes generated from the deflection yoke 21 can be generated to effectively compensate magnetic fields leaked due to a positional relationship between magnetic materials such as the shadow mask 29 and the inner magnetic shield 33 and the front and rear side pairs of compensating coil units.

3) When the front and rear sides pairs of compensating coil units 22a, 22b and 22c, 22d are arranged as shown in FIGS. 5A and 5B and current which is proportional in level to horizontal deflection current is applied to these coil units, the deflection power loss of the deflection yoke 21 can be reduced. Namely, the deflection power usually depends upon the impedance Z of the deflection coil unit wherein the resistance of deflection and compensating coil units is represented by R and their inductance by L, thus $|Z| =$ $$\sqrt{R^2 + (2\pi fL)^2}\ .$$

In order to reduce the deflection power, the inductance of that compensating coil unit which takes no part in deflection may be lowered. In the case of the compensating coil unit, $R << 2\pi fL$ wherein the number of turns of the coil unit is denoted by N and the level of magnetic flux generated is denoted by $\phi$, thus $L = N\phi/I \propto N^2$. The deflection power therefore becomes larger in proportion to the number N of turns of each coil unit. On the other hand, the level of compensating fluxes generated by plural pairs of compensating coil units is proportional to the total of numbers of turns of these coil units.

When two pairs of compensating coil units 22a, 22b, 22c and 22d, are used as seen in the case of the cathode ray tube apparatus shown in FIGS. 5A and 5B, the total of numbers of turns of these coil units becomes substantially equal to that of one pair of compensating coil units in the case of the conventional apparatus, but L becomes smaller and the total of inductances of the two paired coil units is made smaller even if compensating magnetic fluxes by the two paired coil units are equal to those of the one paired coil units. As the result, the power loss can be further reduced by the two paired coil units 22a, 22b and 22c, 22d and the deflection power loss of the yoke 21 can be thus reduced to a greater extent.

Figure 7A:
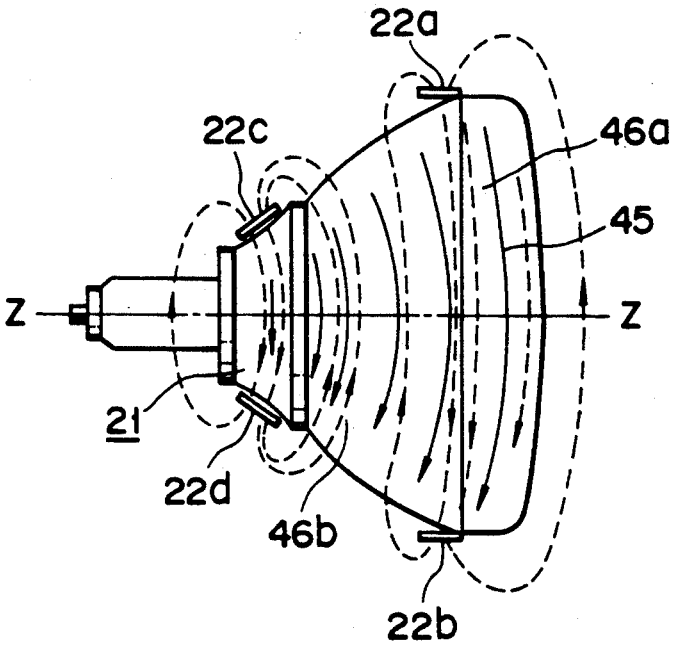
FIGS. 7A and 7B (prior art) show distributions of magnetic fluxes intended to explain how compensating magnetic fluxes effect the landing characteristic in the cathode ray tube apparatus shown in FIGS. 5A and 5B which is provided with two pairs of compensating coil units, FIG. 7A, and how compensating magnetic fluxes affect the landing characteristic when the conventional cathode ray tube apparatus is provided with a pair of compensating coil units, FIG. 7B (prior art).
Figure 7B:
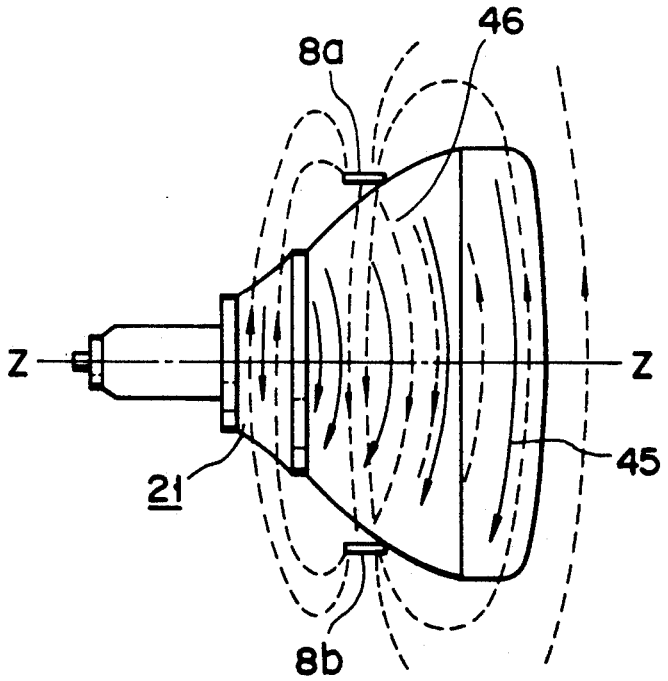

4) In the case of the conventional cathode ray tube apparatus in which one pair of compensating coil units are arranged on the plane which passes through the center of horizontal deflection leakage magnetic fluxes, compensating magnetic fluxes 46 which are directed in same direction as effective magnetic fluxes 45 generated from the horizontal deflection coil unit of the deflection yoke 21 are generated, as shown in FIG. 7B (prior art), at that area through which the electron beams pass. The electron beams are thus deflected to a greater extent and their landing is shifted outside the three phosphor layers of the phosphor screen.

In the apparatus wherein the front and rear sides pairs of compensating coil units 22a, 22b and 22c, 22d are arranged, as shown in FIG. 7A, on both sides of the plane perpendicular to the tube axis and passing through the centers of horizontal deflection leakage magnetic fields, the front side pair of compensating coil units 22a and 22b generate compensating magnetic fluxes 46a in a same direction as the effective magnetic fluxes 45 in a space in which the electron beams passes by the horizontal deflection coil unit of the deflection yoke 21. However, the rear side pair of compensating coil units 22c and 22d generate compensating magnetic fluxes 46b in an opposite direction of the effective magnetic fluxes 45. The total of compensating magnetic fluxes can be thus made substantially zero in the electron-beams-passing space, thereby preventing the electron beams from being landed outside their respective phosphor layers.

5) When the front and rear sides pairs of compensating coil units are arranged, as shown in FIGS. 5A and 5B, their attaching positions can be changed more freely and easily.

Table 1 shows more concrete values of the two pairs of compensating coil units 22a, 22b and 22c, 22d which are employed by the color cathode ray tube apparatus according to the present invention, and those of the one pair of compensating coil units 8a and 8b which are employed by the conventional cathode ray tube apparatus.

TABLE 1

| | | Size of compensating coil unit | Number of turns | Position |
|---|---|---|---|---|
| Our example | Front side compensating coil unit | 12 mm × 120 mm | 9 | Adjacent to the panel of the funnel and on the magnetic core of the horizontal deflection yoke |
| | Rear side compensating coin unit | 35 mm × 55 mm | 4 | |
| Conventional one | | 28 mm × 120 mm | 11 | A little before the centers of magnetic fluxes and on the funnel |

Table 2 shows the comparison of characteristics of the cathode ray tube apparatus, in which the two pairs of compensating coil units 22a, 22b and 22 22d each having the values shown in Table 1 are included, with those of the cathode ray tube apparatus in which only the one pair of compensating coil units 8a and 8b each having the value shown in Table 1 are included. Induced magnetic flux density dB/dt and magnetic flux density B shown in Table 2 are values at the distance of 30 cm before the panel and the maximum values at the distance of 65 cm on the sphere around the center of the VDU and at an angle of $-45° \leqq 0 \leqq 45°$ relative to the horizontal plane. The increased parts of inductance of the horizontal deflection system are denoted by percentages before and after the horizontal deflection coil unit is connected in series to the compensating coil units.

As shown in Table 2, the induced magnetic flux densities dB/dt are 13 mT/s at the distance of 30 cm before the panel and 9 mT/s on the sphere having a radius of 65 cm around the center of the VDU and the increased part of inductance is 9.3%, which values are the best achieved by the conventional cathode ray tube apparatus in which the one pair of compensating coil units are included. When the two pairs of compensating coil units are used in such a way that the one pair of them are located adjacent to the panel of the funnel and opposed to each other parallel to and in front of the plane perpendicular to the tube axis and passing through the centers of horizontal deflection leakage magnetic fields and the other pair of them are located on the magnetic core of the deflection yoke and opposed to each other parallel to and at the back of the plane, the induced magnetic flux density dB/dt can be reduced to 6 mT/s at the distance of 30 cm before the panel and the increased part of inductance to 7.8%.

When the compensating assembly for generating compensating magnetic fluxes to reduce horizontal deflection leakage magnetic fluxes includes plural pairs of compensating coil units and at least one pair of them are located on one side of the plane perpendicular to the tube axis and passing through the centers of horizontal deflection leakage magnetic fluxes while at least the other pair of them are on the other side of the plane, as described above, compensating magnetic fluxes generated from the one pair of them on one side of the plane can be made almost in phase with the horizontal deflection leakage magnetic fields in front of the phosphor screen to effectively compensate the horizontal deflection leakage magnetic fluxes. Thus, horizontal deflection leakage magnetic fluxes can be effectively compensated by compensating magnetic fluxes.

As described above, the present invention can provide a cathode ray tube apparatus capable of fully com-

TABLE 2

| | | Level of magnetic field leaked | | Increased part of inductance due to the horizontally-deflecting system comprising compensating coil units |
|---|---|---|---|---|
| | | Induced magnetic flux density dB/dt (mT/s) | Magnetic flux density B (nT) | |
| Our example | At 30 cm before the panel | 6 | 9 | 7.8 |
| | On the sphere having a radius of 65 cm | 9 | 14 | |
| Conventional one | At 30 cm before the panel | 13 | 24 | 9.3 |
| | On the sphere having a radius of 65 cm | 9 | 12 | |
| No paired compensating coil units provided | At 30 cm before the panel | 104 | 166 | — |
| | On the sphere having a radius of 65 cm | 64 | 87 | |

pensating leakage magnetic fluxes, particularly those leaked in front of the phosphor screen of the VDU.

Additional advantages and modifications will readily occur to those skilled in the art. Therefore, the invention in its broader aspects is not limited to the specific details shown and described. Accordingly, various modifications may be made without departing from the spirit or scope of the general inventive concept as defined by the appended claims and their equivalents.

What is claimed is:

1. A cathode ray tube apparatus comprising:
means for generating electron beams;
means for emitting light rays when the electron beams land thereon;
an envelope, having an axis, for receiving the electron beam generating means and light ray generating means;
means, provided on the envelope, for generating effective magnetic fluxes in the envelope to deflect the electron beams in the horizontal direction and also generating leakage magnetic fluxes outside the envelope, said leakage magnetic fluxes emanating about a center between said magnetic flux generating means and said emitting means;
first means, provided on one side from a first reference plane extending through the center of the leakage magnetic field, perpendicular to the axis and crossing the envelope, for generating first compensating magnetic fluxes in a direction reverse to that of the leakage magnetic fluxes;
second means, provided on the other side from the first reference plane, for generating second compensating magnetic fluxes in the direction reverse to that of the leakage magnetic fluxes; and
signal generating means for generating a signal to energize the deflection magnetic flux generating means and the first and second compensating magnetic flux generating means.

2. The cathode ray tube apparatus according to claim 1, wherein said first compensating magnetic flux generating means includes first and second electromagnetic coil units located on both sides of a second reference plane parallel to the horizontal direction and including the tube axis to generate compensating magnetic fluxes, and said second compensating magnetic flux generating means includes third and fourth electromagnetic coil units located on both sides of the second reference plane to generate compensating magnetic fluxes.

3. The cathode ray tube apparatus according to claim 2, wherein said first, second, third and fourth electromagnetic coil units are electrically connected in series to the deflection magnetic flux generating means.

4. The cathode ray tube apparatus according to claim 2, wherein said first, second, third and fourth electromagnetic coil units are electrically connected parallel to the deflection magnetic flux generation means.

5. The cathode ray tube apparatus according to claim 1, wherein said signal generator means generates horizontal deflection current and supplies the current to the deflection magnetic flux generating means and the first and second compensating magnetic flux generating means to energize them.

6. The cathode ray tube apparatus according to claim 1, wherein said signal generator means generates horizontal deflection current and supplies it to the deflection magnetic flux generating means to energize the deflection magnetic flux generating means and said signal generator means also generates first and second compensating currents synchronous to the horizontal deflection current and supplies them to the first and second compensating magnetic flux generating means to energize these means.

7. The cathode ray tube apparatus according to claim 1, wherein said electron beams generating means generates three electron beams and said light rays emitting means generates different light rays when said three electron beams land thereon.

8. A cathode ray tube apparatus comprising:
an envelope, having an axis, including a panel provided with a face plate and a skirt continuous to the face plate, a funnel connected to the skirt of the panel and a neck extending from the funnel;
an electron gun assembly, received in the neck, for generating an electron beam;
a screen, formed on the face plate, for generating light rays when the electron beam lands thereon;
means, provided at the funnel, for generating magnetic fluxes to deflect the electron beam in the horizontal direction and leakage magnetic fluxes outside the envelope, said leakage magnetic fluxes emanating about a center between said flux generating means and said screen;
first and second electromagnetic coil units, located on opposite sides of a horizontal reference plane parallel to the horizontal direction and aligned with the tube axis, respectively, and toward the face plate from a vertical reference plane perpendicular to the tube axis and extending through the center of the leakage magnetic field, for generating first compensating magnetic fluxes in a direction opposite to that of the leakage magnetic fluxes; and
third and fourth electromagnetic coil units, located on opposite sides of the horizontal reference plane, respectively, and toward the neck from the vertical reference plane, for generating second compensating magnetic fluxes in the direction opposite to that of the leakage magnetic fluxes.

9. The cathode ray tube apparatus according to claim 8, wherein said first and second electromagnetic coil units are arranged around the funnel.

10. The cathode ray tube apparatus according to claim 8, wherein said first and second electromagnetic coil units are arranged around the outer circumference of the skirt.

11. The cathode ray tube apparatus according to claim 8, wherein said electron gun assembly generates first, second and third electron beams and said screen generates different light rays when the first, second and third electron beams are landed thereon.

12. The cathode ray tube apparatus according to claim 8, further comprising; a magnetic shield arranged in the envelope to prevent magnetic fields from being leaked in the envelope.

13. The cathode ray tube apparatus according to claim 8, wherein said deflection magnetic flux generating means includes a magnetic core and coils wound round the magnetic core and said third and fourth electromagnetic coil units are arranged around the magnetic core.

* * * * *